United States Patent [19]

Mutschler et al.

[11] 4,120,498

[45] Oct. 17, 1978

[54] AMUSEMENT SYSTEM

[75] Inventors: Steven C. Mutschler, 2070 Garden Springs Dr., Lexington, Ky. 40504; Loane J. Randall, Naples, Fla.

[73] Assignee: Steven C. Mutschler, Lexington, Ky.

[21] Appl. No.: 791,051

[22] Filed: Apr. 26, 1977

[51] Int. Cl.[2] ..... A63B 67/06

[52] U.S. Cl. ..... 273/99

[58] Field of Search ..... 273/95 R, 95 A, 97 R, 273/97 A, 98, 99

[56] References Cited

U.S. PATENT DOCUMENTS

| | | | |
|---|---|---|---|
| 1,519,936 | 12/1924 | Schneider | 273/97 A |
| 2,942,886 | 6/1960 | Ackerman | 273/99 |
| 2,950,917 | 8/1960 | Lyon | 273/99 |
| 2,950,918 | 8/1960 | Lyon | 273/99 |

FOREIGN PATENT DOCUMENTS

| | | | |
|---|---|---|---|
| 394,212 | 11/1908 | France | 273/99 |
| 178,832 | 10/1935 | Switzerland | 273/99 |

*Primary Examiner*—William H. Grieb
*Attorney, Agent, or Firm*—Morton J. Rosenberg

[57] ABSTRACT

A tethered ring like amusement system where a washer like member is flexibly supported from a first rod vertically extending from a base member. The washer or annular disk is swung to a second vertically extending rod member having secured thereon a number of hook elements. The object of the amusement system is to releasably capture the annular disk on one of the hook members. The hook members extending from the second rod member are mounted in differing planes and at differing vertical heights above the base member. The tethered ring like game further includes a second target rod mounted to the base member and inclined with respect thereto. The second target rod serves a dual purpose of being both a target area such that the annular disk may be impaled thereon as well as providing a blocking element such that at least one of the hook members mounted on the second rod member cannot directly cause impalation of the annular disk. Releasable capturing of the annular disk on either the second target rod member or on the hook members mounted on the second rod necessitate differing skill difficulties for the operator. In an embodiment of the tethered ring like game, a plurality of second target rod members are mounted on the base member to restrict the displacement path of the annular disk and further increase the skill necessary for releasable capturing of the annular disk in one of the target areas.

9 Claims, 5 Drawing Figures

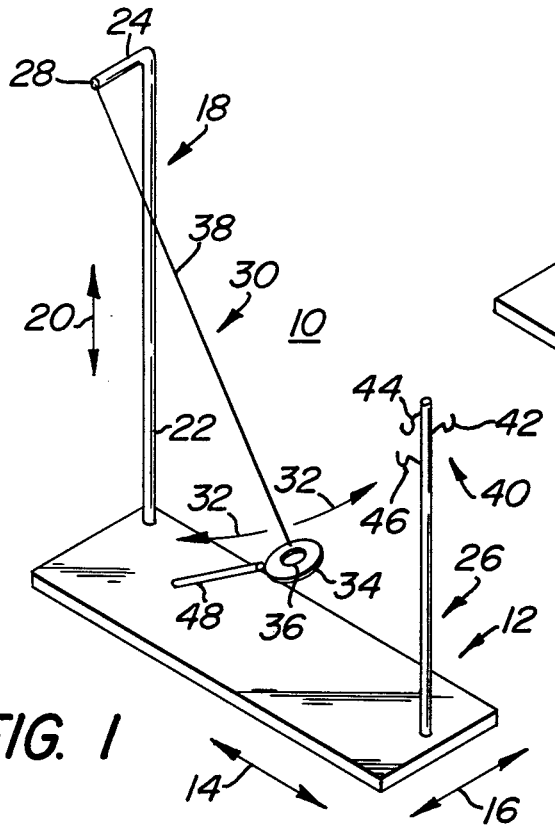
FIG. 1
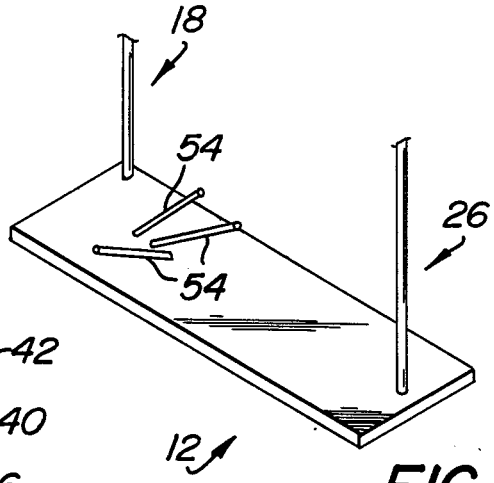
FIG. 5
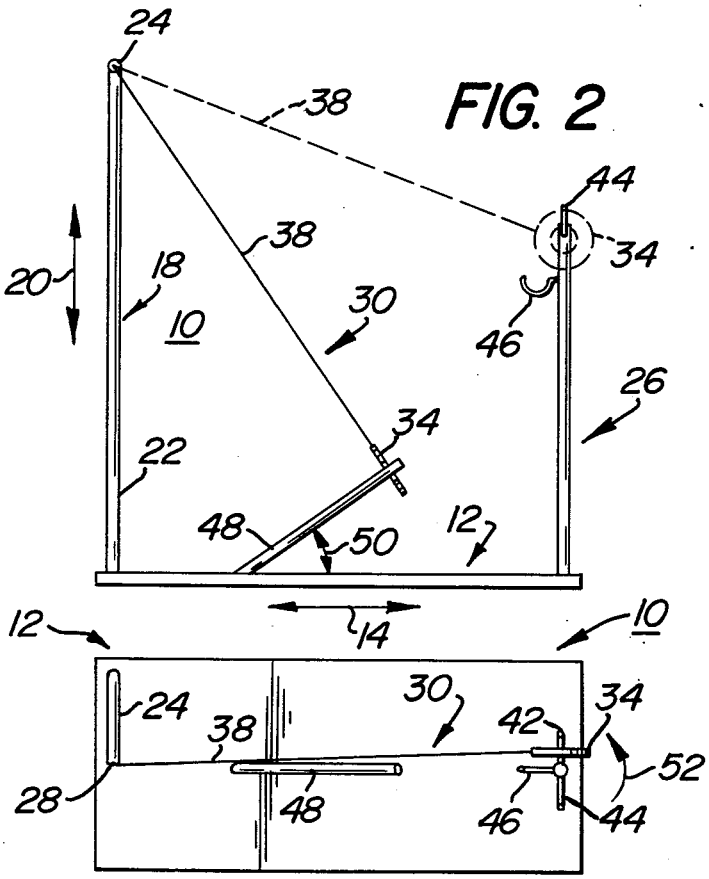
FIG. 2
FIG. 3
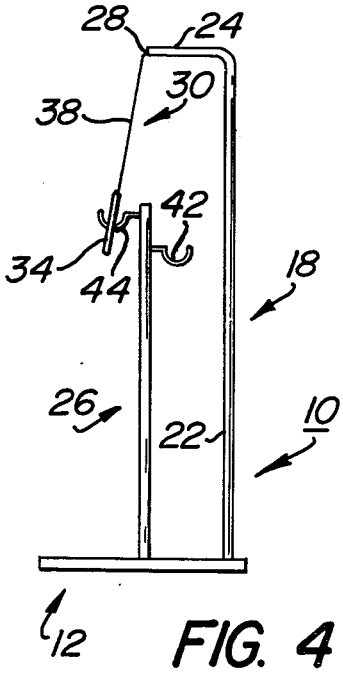
FIG. 4

AMUSEMENT SYSTEM

BACKGROUND OF THE INVENTION

1. Field of the Invention

This invention relates to amusement systems. Still further, this invention relates to amusement systems utilizing a projectile to be releasably captured in one of a number of target areas. More in particular, this amusement system is directed to a tethered ring like game where an annular disk is flexibly mounted to one rod member and is displaced to a particular target area. More in particular, this amusement system relates to a target area having a plurality of hook members for impalation of an annular disk. Still further, this invention pertains to a tethered ring like game where target hook members are mounted in differing planes and differing vertical heights above a base member in order to increase the difficulty of releasably capturing the annular disk on one of the hook members. Further, this invention relates to an amusement system having a second target rod member mounted to a base member for impalation of an annular disk. Still further, this invention pertains to a tethered ring like game where a second target rod member serves the dual purpose of being a target zone as well as blocking particular displacement paths to the first target hook members and requiring differing arcuate paths of the annular disk for impalation on such hook members.

2. Prior Art

Tethered ring like games are well known in the art. However, some of such games as represented by U.S. Pat. No. 2,942,886 utilize a tethered ring for mounting on a hook member which is apparently co-planar with an extension member. In such prior systems, there is apparently no provision for the target hooks to be positionally located out of plane with respect to each other which has the disadvantage of decreasing the difficulty of the amusement system. Additionally, such prior art devices do not provide for target poles mounted on a base member to provide both a target area as well as a blocking displacement path for the tethered ring which has the disadvantage of lowering the skill necessary.

In some prior systems as that provided by U.S. Pat. No. 2,950,918, there are provided other tethered ring like games where the object of the game is to positionally locate the ring on a hook member. In such prior art systems, the hook is generally co-planar with an extension arm and no provision is apparently made for a plurality of hook members extending out of plane with an initial hook to increase the difficulty of the game.

In other types of tethered ring like games such as that shown in U.S. Pat. No. 2,950,917, the ring is mounted to a suspension arm through a cord. In these types of game devices, there are a plurality of hook members upon which the ring is to be positionally located. However, in such devices, the hooks are mounted on a standard and appear to be in a co-planar direction each with respect to the other and further apparently co-planar with respect to the arm member. Thus, such prior art devices do not make the provision for a plurality of hook members out of plane each with respect to the other and further out of plane with respect to a suspension arm which decreases the difficulty and skill in providing releasable capture of the ring.

SUMMARY OF THE INVENTION

An amusement system which includes a longitudinally extended base member. A first rod member is secured to the base member and the first rod member extends in a substantially vertical direction above the base member. A tethered projectile device is secured to the first rod member. A second rod member is secured to the base member and is longitudinally displaced from the first rod member. A first target mechanism is secured to the second rod member for releasably capturing the tethered projectile device. A second target mechanism is secured to the base member and is positionally located for interception of a displacement path of the tethered projectile device.

BRIEF DESCRIPTION OF THE DRAWINGS

FIG. 1, is a perspective view of the amusement device;

FIG. 2, is a frontal view of the amusement device showing the tethered projectile device mounted on a second target rod as well as on a first target hook member;

FIG. 3, is a top view of the amusement device showing the tethered projectile device being releasably captured on one of the first target hook members;

FIG. 4, is an elevation view of the amusement device; and,

FIG. 5, is a perspective view partially cut away of an embodiment of the amusement device showing a plurality of second target rods mounted to a base member.

DESCRIPTION OF THE PREFERRED EMBODIMENTS

Referring now to FIGS. 1–4 there is shown amusement system 10 for the specific purposes of applying the skills of an operator or a plurality of operators to a target like game. In overall concept, amusement system 10 is directed to provide amusement and enjoyment of one or more operators participating in the game. System 10 is further directed to a tethered ring like game where the object of the game is to releasably capture a projectile within a particular target area by providing a particular displacement path for the projectile.

Amusement system 10 as is shown in FIG. 1, includes base member 12 which extends in longitudinal direction 14. Base member 12 is generally planar and is adapted to rest on a base surface. Base member 12 may be rectangular in overall geometric contour as is shown in FIG. 1 or may be of another type of contour not important to the inventive concept. However, base member 12 should have a dimension in transverse direction 16 for purposes to be described in following paragraphs. Member 12 may be formed of wood, plastic, or some like material not important to the invention as is herein described, with the exception that member 12 should be formed of a material of sufficient structural integrity so as to support elements mounted thereon in rigid constrainment.

Amusement system 10 further includes first rod member 18 which is secured to base member 12 as is shown in FIGS. 1–4. First rod member 18 is secured in a rigid manner to base member 12 through bolts, threaded securement, force fitting into an opening formed in member 12, or in some like manner. First rod member 18 extends in vertical direction 20 above base member 12. First rod member 18 may be formed of wood, plastic, or some like material of sufficient structural integrity such that rod member 18 may remain in a fixed positional location during use of amusement system 10.

First rod member 18 includes an overall L-shaped contour. Member 18 includes vertical extension member 22 and transversely directed extension member 24 extending in direction 16 as is shown. Vertical extension member 22 is transversely displaced from second rod member 26 for purposes to be described in following paragraphs. Extension members 22 and 24 of first rod member 18 may be formed in one piece construction or may be formed of two separate members. In general, transverse member 24 lies in a plane which is parallel to base member 12. As can be seen from FIGS. 1–4, end section 28 of transverse member 24 is aligned with second rod member 26 in longitudinal direction 14.

Tethered projectile mechanism 30 is secured to first rod member 18 at end section 28 of transverse member 24. Projectile mechanism 30 is adapted to swing in a displacement arc or path one of which is shown by arcuate arrows 32. Tethered projectile mechanism 30 includes closed contour member 34 having a centrally disposed opening 36. Cord member 38 is secured on opposing ends to first rod member 18 and to closed contour member 34. Cord member 38 may be formed of a textile material, plastic, or some like material not important to the inventive concept as is herein described with the exception that such be flexible in nature to allow arcuate displacement of closed contour member 34. Cord member 38 is secured to end section 28 of element 24 by tieing, molding, or some like means. Further, cord member 38 may be secured to closed contour member 34 by similarly tieing or other fixed constrainment mechanism. Closed contour member 34 may be washer like in construction and generally, but not necessarily, may have the overall geometric contour of an annular disk.

Second rod member 26 is mounted and secured to base member 12 in rigid constrainment. Member 26 as is clearly seen in FIGS. 1 and 2 is longitudinally displaced from first rod member 18 and further extends in vertical direction 20. Second rod member 26 may be formed of wood, plastic, or some like rigid material sufficient in structural integrity so as to allow positional restraint of member 26 during operation of the game. Additionally, second rod member 26 may be rigidly secured to base member 12 by force fit, threaded securement, or some like technique not important to the inventive concept as is herein described. Rod members 18 and 26 are longitudinally displaced each from the other a distance sufficient to allow impaling or releasably capturing washer or closed contour member 34 in a target area on second rod member 26. The longitudinal displacement of members 18 and 26 is shown in FIG. 2 by the phantom line of cord member 38 and closed contour member 34.

First target device 40 is secured to second rod member 26 and as will be seen is utilized for releasably capturing tethered projectile mechanism 30. First target device 40 includes a plurality of hook members 42, 44, and 46 which are securely fastened to second rod member 26 for impaling tethered projectile mechanism 30 responsive to a predetermined displacement path of tethered projectile mechanism 30 when swung about end section 28 of element 24 of first rod member 18. Each of hooks 42, 44, and 46 may be mounted to second rod member 26 by threaded securement or some like securement mechanism. Additionally, it will be noted that hook members 42 and 44 are mounted on opposing transverse sides of the second rod member 26. Hook member 46 is generally longitudinally aligned with end section 28 of element 24 and as is seen extends in a longitudinal direction 14. Each of hook members 42, 44, and 46 extend from second rod member 26 in a plane intersecting an extension plane of each of the other hook members 42, 44, and 46. Hook members 42, 44, and 46 all include an arcuate end section in order that once closed contour member 34 is impaled or releasably captured on a particular hook member, that washer 34 will not be displaced therefrom. In overall concept, hook members 42, 44, and 46 are secured to second rod member 26 in a manner such that at least one of hook members 42, 44, and 46 extend in a direction substantially orthogonal to another hook members 42, 44, and 46. In this manner, it will be noted that the displacement path for closed contour member 34 will be different for releasably capturing member 34 on each of hook members 42, 44 and 46. This has the advantage of providing additional necessary skills in the operators actuating path displacement of closed contour member 34.

Further, it is to be understood that hook members 42, 44, and 46 are secured to second rod member 26 at differing vertical heights above base member 12. This further requires different displacement paths for closed contour member 34 dependent upon which of hook members 42, 44, and 46 is to be used as a particular target area. Thus, it is seen, that the particular positional locations of hook members 42, 44, and 46 provide for increased skill difficulties in the particular placement of contour member 34 on a particular hook member 42, 44, and 46.

Amusement system 10 further includes second target rod 48 secured to base member 12 as is seen in FIGS. 1–3. Of importance, second target rod 48 is positionally located for intersection of a particular displacement path of tethered projectile mechanism 30 as will be explained in following paragraphs. Second target rod 48 is rigidly fastened to base member 12 by force fit, threaded securement, or some like technique not important to the inventive concept as is herein described with the exception that once positionally located, second target rod 48 is to be maintained in a fixed positional location. Additionally, second target rod 48 may be formed of wood, plastic, or some like rigid material.

Second target rod 48 is inclined with respect to base member 12 as is shown in the figures and is positionally located for blocking at least one displacement path of closed contour member 34 when such is placed in motion to be releasably captured on first target device 40 secured to second rod member 26. As can be seen in the preferred embodiment shown in FIGS. 1–3, second target rod 48 is generally longitudinally aligned with second rod member 26 and end section 28 of element 24 of first rod member 18. Additionally, inclined angle 50 of second target rod 48 shown in FIG. 2 is not of important consequence with the exception that the length of second target rod 48 in combination with inclined angle 50 be in cooperation such that closed contour member 34 may be releasably captured by second target rod 48 as shown in FIG. 2. Still further, the diameter of second target rod 48 should be less than the diameter of opening 36 in order that second target rod 48 be adapted for releasably capturing closed contour or washer member 34 thereon.

In order for closed contour member 34 to be releasably captured by hook member 44 it will be seen from FIG. 3, that second target rod 48 presents no blocking factor. Thus, the user may swing member 34 in a fairly free path to impinge on hook member 44 since hook member 44 extends transverse to second target rod 48. Additionally, since hook member 46 lies in substantially longitudinal alignment with second target rod 48, a more careful arcuate path must be provided by the user actuation in order for releasable capture by hook member 46 of washer member 34. However, it will be further understood that second target rod 48 presents an impediment to the path of closed contour member 34 when the operator wishes to have hook member 42 releasably capture closed contour member 34. Thus, in order to allow capturing by hook member 42, the user must swing closed contour member 34 in an arcuate member around second rod member 26 in a path as seen by arcuate arrow 52 of FIG. 3. This still further increases the skill necessary by the user to impale washer 34 by hook member 42. Thus, it is seen that second target rod 48 serves a dual purpose of providing a target for the user as is seen in FIG. 2, and further as a blocking mechanism to increase the difficulty of causing releasable capture of closed contour member 34 on a particular hook member 42.

It has been previously noted that member 22 is transversely displaced from second rod member 26. This transverse displacement is provided to permit a generally free swinging arc of annular disk 34, diminishing the chance of disk 34 impacting vertical member 22 on a backswing portion of the displacement path.

An embodiment of amusement system 10 is shown in FIG. 5. In this embodiment, a plurality of second target rods 54 are securely fastened to base member 12. Each of second target rod members 54 in this embodiment are shown to be inclined with respect to base member 12. Each of second rod members 54 block at least one displacement path of closed contour member 34 when such is being aimed for first target device 40. This embodiment still further increases the difficulty of the game in that the operator must aim and displace closed contour member 34 in a restricted area to allow releasable capture of member 34 by one of hook members 42, 44, or 46.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described. Certain structures may be used independently of others, and in certain cases particular locations of elements may be reversed or interposed, all without departing from the spirit or scope of the invention as defined in the appended claims.

What is claimed is:

1. An amusement system comprising:

(a) a longitudinally extended base member;

(b) a first rod member secured to said base member, said first rod member extending in a substantially vertical direction above said base member;

(c) tethered projectile means secured to said first rod member;

(d) a second rod member secured to said base member, said second rod member being longitudinally displaced from said first rod member;

(e) first target means secured to said second rod member for releasably capturing said tethered projectile means; and, (f) second target means secured to said base member, said second target means being positionally located for interception of a displacement path of said tethered projectile means, said second target means including at least one target rod member being inclined with respect to said base member for blocking at least one displacement path of said tethered projectile means to said first target means.

2. The amusement system as recited in claim 1 where said second target means includes a plurality of target rod members being inclined with respect to said base member, said second target rod members for blocking at least one displacement path of said tethered projectile means to said first target means.

3. The amusement system as recited in claim 1 where said target rod member is adapted for releasably capturing said tethered projectile means.

4. The amusement system as recited in claim 1 where said first target means includes at least one hook member securely fastened to said second rod member for impaling said tethered projectile means responsive to a predetermined displacement path of said tethered projectile means.

5. The amusement system as recited in claim 1 where said first target means includes a plurality of hook members securely fastened to said second rod member, each of said hook members extending from said second rod member in a plane intersecting an extension plane of each of said other hook members.

6. The amusement system as recited in claim 1 where said first target means includes a plurality of hook members securely fastened to said second rod member, at least one of said hook members extending in a direction substantially orthogonal to another of said hook members.

7. The amusement system as recited in claim 6 where said hook members are secured to said second rod member at differing vertical heights above said base member.

8. The amusement system as recited in claim 1 where said first rod member includes an L-shaped contour, said vertical extension of said first rod member being transversely displaced from said second rod member.

9. The amusement system as recited in claim 1 where said tethered projectile means includes:

(a) a closed contour member having a central opening; and, (b) a cord member secured on opposing ends to said first rod member and said closed contour member.

* * * * *